United States Patent [19]

Imamura

[11] 4,339,978

[45] Jul. 20, 1982

[54] ELECTRONIC MUSICAL INSTRUMENT WITH PROGRAMMED ACCOMPANIMENT FUNCTION

[75] Inventor: Akio Imamura, Hamamatsu, Japan

[73] Assignee: Nippon Gakki Seizo Kabushiki Kaisha, Hamamatsu, Japan

[21] Appl. No.: 176,044

[22] Filed: Aug. 7, 1980

[30] Foreign Application Priority Data

Aug. 7, 1979 [JP] Japan ..... 54-108742[U]

[51] Int. Cl.[3] ..... G10F 1/00

[52] U.S. Cl. ..... 84/1.03; 84/DIG. 12; 84/DIG. 22; 84/1.24

[58] Field of Search ..... 84/DIG. 12, DIG. 22, 84/1.03, 1.24

[56] References Cited

U.S. PATENT DOCUMENTS 4,129,055 12/1978 Whittington et al. ..... 84/DIG. 22

4,256,005 3/1981 Mishima ..... 84/DIG. 12

4,314,493 2/1982 Kondo ..... 84/1.03

*Primary Examiner*—J. V. Truhe

*Assistant Examiner*—Forester W. Isen

*Attorney, Agent, or Firm*—Spensley, Horn, Jubas & Lubitz

[57] ABSTRACT

An electronic musical instrument capable of providing automatic bass and chord accompaniments, either in accordance with a program prepared by the player or in immediate response to the depressing of a minimum number of keys on lower and pedal keyboards. The programmed accompaniments proceed sequentially (in steps) with successive measures of accompaniment data being read from a memory. By making some of these measures blank in introducing the accompaniment data into the memory, therefore, the player can play desired bass and chord accompaniments by direct key depression during the blank measures. In an alternative embodiment the production of the programmed accompaniments is automatically inhibited during the production of key-responsive accompaniments, thereby enabling the player to override the programmed accompaniments at any time.

9 Claims, 5 Drawing Figures

ELECTRONIC MUSICAL INSTRUMENT WITH PROGRAMMED ACCOMPANIMENT FUNCTION

BACKGROUND OF THE INVENTION

My invention pertains to electronic musical instruments in general and, in particular, to those with an automatic accompaniment function. My invention is directed more particularly to an electronic musical instrument equipped with means for providing automatic bass and chord accompaniments in accordance with a program prepared by the player, together with means for the insertion, during the progress of the programmed accompaniments, of unprogrammed accompaniments in response to depressing of the keys on the keyboards used for such accompaniments.

An assortment of easy-to-play features have been built into the electronic musical instrument to enhance its practical utility and to add to the enjoyment of performance. Among such features is the programmed accompaniment function. If the player inputs a program or data for a desired sequence of bass and chord accompaniments, for example, into a memory or storage device within the instrument, it will automatically sound the programmed bass and chord accompaniments, enabling the player to concentrate on playing melodies.

As heretofore incorporated in the electronic musical instrument, however, the programmed accompaniment function possesses one drawback, i.e., the total exclusion of the player from the performance of accompaniments. He or she cannot in any way take part in the accompaniments during their programmed progress. The player must, therefore, cancel the programmed accompaniment mode of the instrument, as by the actuation of an appropriate switch, for playing some unprogrammed accompaniments in the course of the programmed accompaniments.

SUMMARY OF THE INVENTION

My invention seeks to overcome the noted drawback of the prior art by enabling the player to play a desired accompaniment during the progress of a programmed accompaniment. More specifically my invention seeks to enable the player to play an automatic (or semiautomatic, to be more exact) accompaniment at any time or at preassigned times while the programmed accompaniment is in progress.

Stated in its perhaps broadest aspect, my invention provides an improved electronic musical instrument including an accompaniment data memory or storage, together with means for introducing a desired sequence of accompaniment data into the memory, and means for recovering the accompaniment data from the memory in the desired sequence. Also included are means for producing an accompaniment both in accordance with the accompaniment data being recovered from the memory and in response to depressing of the keys of usual keyboard means.

In some preferable embodiments of my invention the electronic musical instrument produces bass and chord accompaniments in response to the programmed accompaniment data and also provides automatic bass and chord accompaniments when the player depresses a prescribed minimum number of keys on lower and pedal keyboards. One recommended practice, therefore, is to create a blank or blanks in the sequence of accompaniment data when such data are being written on the memory. Then the player can play desired automatic bass and chord accompaniments on the pedal and lower keyboards during the blank or blanks in the programmed accompaniments.

It is also possible, as disclosed in an additional embodiment, to prevent the production of the programmed accompaniments whenever the player depresses keys on the pedal and lower keyboards to play some unprogrammed accompaniments. The player can then override the programmed accompaniments at any time, without the need for switching the instrument out of the programmed accompaniment mode.

The above and other objects, features and advantages of my invention and the manner of attaining them will become more apparent, and the invention itself will best be understood, from a study of the following description of the preferred embodiments taken together with the attached drawings.

DESCRIPTION OF THE PREFERRED EMBODIMENTS

General

Figure 1:
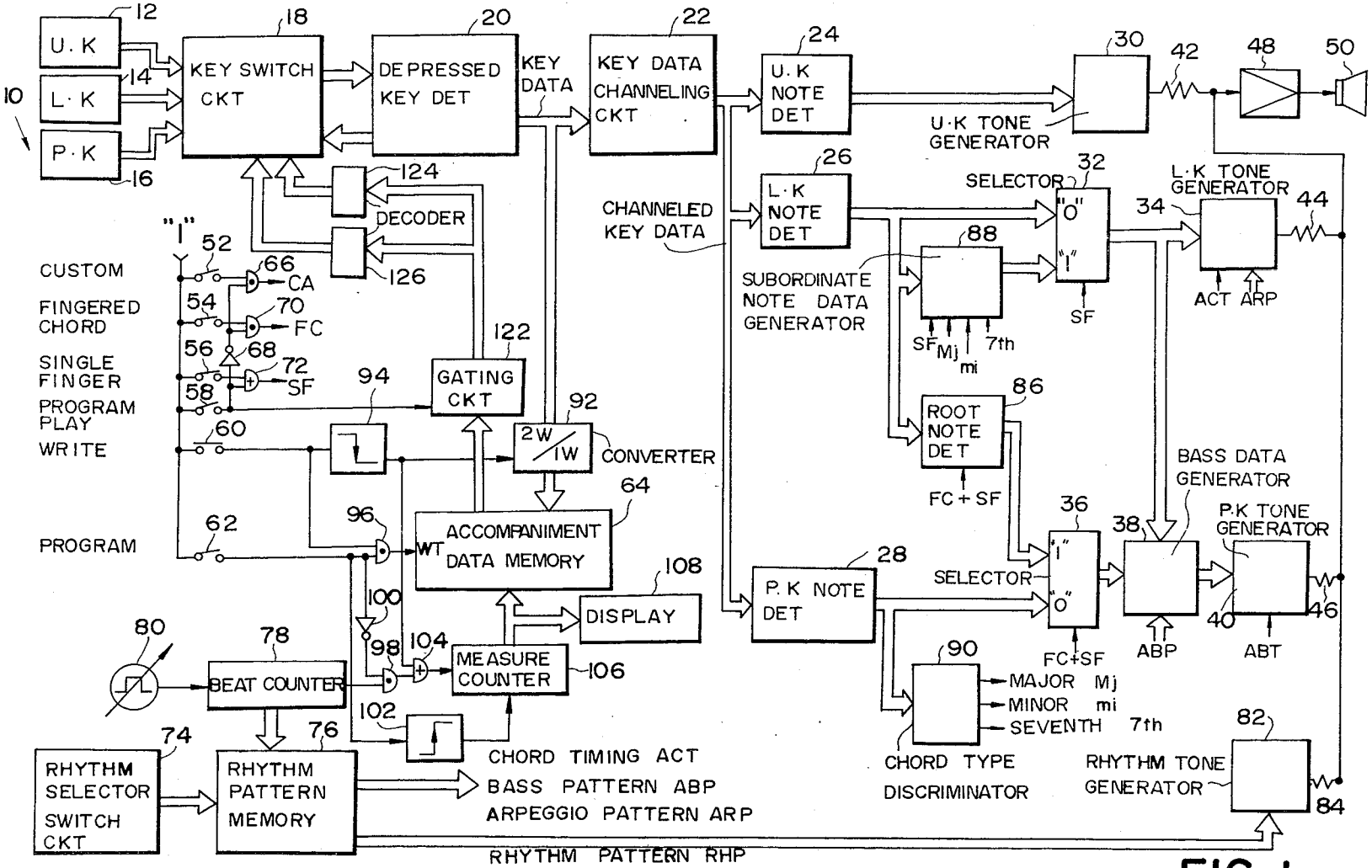
FIG. 1 is a block diagram of a preferred form of the electronic musical instrument in accordance with my invention.

I will now describe my invention as adapted specifically for an electronic musical instrument capable of providing automatic bass and chord accompaniments (AUTO BASS/CHORD) in any of three different modes, plus the programmed accompaniment function. With reference first to FIG. 1 the illustrated electronic musical instrument, generally labeled 10, includes an upper keyboard or manual 12, a lower keyboard or manual 14, and a pedal keyboard or clavier 16. At 18 is shown a key switch circuit comprising an array of key switches (described later in connection with FIG. 3) which are to be actuated respectively by the keys in the three keyboards 12, 14 and 16. The term "keys", as used generically in this specification and in the claims appended thereto, should be interpreted to denote not only the manual keys of the upper and lower keyboards 12 and 14 but also the pedal keys of the pedal keyboard 16.

The key switch circuit 18 is coupled to a depressed key detector circuit 20, which functions to detect the depression of the keys in the keyboards 12, 14 and 16. The depressed key detector 20 can be of the prior art design, detecting the depressed keys by the time-division scanning of the key switches of the circuit 18 and generating binary-coded information (hereinafter referred to as the key information or key data) indicative of the depressed keys. The key information consists of, for example:

1. A four-bit note code representative of that one of the twelve notes in each octave which is assigned to each depressed key.

2. A three-bit octave code representative of that one of several octaves to which the note of the depressed key belongs.

3. A two-bit keyboard code representative of that one of the three keyboards 12, 14 and 16 which includes the depressed key.

By the combination of these note, octave, and keyboard codes the key data can represent any individual key in the keyboards 12, 14 and 16.

The depressed key detector 20 is coupled to a key data channeling circuit (channel assigner) 22. The electronic musical instrument 10 is capable of sounding a plurality (e.g., twelve) of notes simultaneously, by allotting such notes to the corresponding number of different sounding channels (tone processing channels). Thus, upon receipt of the key data from the depressed key detector 20, the key data channeling circuit 22 assigns each note to be sounded to either of the sounding channels. The key data channeling circuit 22 can be of the known configuration having a 12-stage/9-bit shift register.

Coupled to the output of the key data channeling circuit 22 are an upper keyboard (UK) note detector circuit 24, a lower keyboard (LK) note detector circuit 26, and a pedal keyboard (PK) note detector circuit 28. The key data channeling circuit 22 puts out, on a time-division basis, the channeled key data, i.e., the information representative of the depressed keys whose notes to be sounded have been assigned to the pertinent sounding channels as above. The time-division multiplexed output from the key data channeling circuit 22 is fed to the three detectors 24, 26 and 28.

The UK note detector 24 is coupled to an upper keyboard (UK) tone generator circuit 30. The LK note detector 26 is coupled via a selector 32 to a lower keyboard (LK) tone generator circuit 34. The PK note detector 28 is coupled via another selector 36 and a bass data generator circuit 38 to a pedal keyboard (PK) tone generator circuit 40.

Receiving the channeled key information from the key data channeling circuit 22, the UK note detector 24 derives therefrom only the key data pertaining to the notes of the upper keyboard 12, for delivery to the UK tone generator 30. The LK note detector 26 likewise derives from the channeled key information only the key data pertaining to the notes of the lower keyboard 14 and delivers those key data to the LK tone generator 34 via the selector 32. Also, deriving from the channeled key information only the key data concerning the notes of the pedal keyboard 16, the PK note detector 28 feeds those key data to the PK tone generator 40 via the selector 36 and bass data generator 38.

The UK tone generator 30, LK tone generator 34, and PK tone generator 40 create and put out upper keyboard (UK) tone signals, lower keyboard (LK) tone signals, and PK tone signals, respectively, in response to their input information. These tone generators 30, 34 and 40 can be of the familiar make comprising a tone source, tone coloring, and envelope generating circuits.

The outputs of the UK tone generator 30, LK tone generator 34, and PK tone generator 40 are coupled via respective mixing resistors 42, 44 and 46 to an amplifier 48 and thence to a loudspeaker 50. Thus the UK tone signals, LK tone signals, and PK tone signals from the circuits 30, 34 and 40 are mixed, amplified, and radiated into the air as audible sounds.

Automatic Accompaniments

The electronic musical instrument 10 is furnished with a set of switches for selective actuation by the player. These switches are a CUSTOM selector switch 52, FINGERED CHORD selector switch 54, SINGLE FINGER selector switch 56, PROGRAM PLAY selector switch 58, WRITE switch 60, and PROGRAM switch 62. The following is a list of the functions obtainable upon activation of these switches:

CUSTOM Selector Switch 52

The CUSTOM function, one mode of AUTO BASS/CHORD performance, which automatically provides a bass accompaniment on the root note as designated by the key which the player depresses on the pedal keyboard 16 and of a chord type determined by the type of chord as detected according to the depression of the keys on the lower keyboard 14, and a chord accompaniment with the notes as designated by the keys which the player depresses on the lower keyboard 14.

FINGERED CHORD Selector Switch 54

The FINGERED CHORD function, another mode of AUTO BASS/CHORD performance, which automatically provides a bass accompaniment with the notes according to the root note and the chord type as detected from the depressed keys on the lower keyboard, and a chord accompaniment with the notes as designated by the keys which the player depresses on the lower keyboard 14.

SINGLE FINGER Selector Switch 56

The SINGLE FINGER function, yet another mode of AUTO BASS/CHORD performance, which automatically provides bass and chord accompaniments with the notes according to the root note as designated by the single key which the player depresses on the lower keyboard 14 and according to the chord type as designated by the depression or non-depression of the "white" or "black" keys on the pedal keyboard 16.

PROGRAM PLAY Selector Switch 58

The programmed accompaniment function wherein bass and chord accompaniments proceed automatically as dictated by accompaniment data that have been written on an accompaniment data memory 64 yet to be described.

WRITE Switch 60

The introduction of desired accompaniment data into the accompaniment data memory 64.

PROGRAM Switch 62

To set the electronic musical instrument 10 into a condition enabling the introduction of the accompaniment data into the accompaniment data memory 64.

The CUSTOM selector switch 52 is connected to a first input of an AND gate 66, to a second input of which is connected the PROGRAM PLAY switch 58 via an inverter 68. The AND gate 66 puts out a binary CUSTOM signal CA. The FINGERED CHORD selector switch 54 is connected to a first input of another AND gate 70, to a second input of which is likewise connected the PROGRAM PLAY switch 58 via the inverter 68. The AND gate 70 puts out a binary FINGERED CHORD signal FC. The SINGLE FINGER selector switch 56 is connected to a first input of an OR gate 72, which has its second input connected directly to the PROGRAM PLAY switch 58. The OR gate 72 puts out a binary SINGLE FINGER signal SF.

Let it now be assumed that the CUSTOM, FINGERED CHORD, and SINGLE FINGER selector swiches 52, 54 and 56 and the PROGRAM PLAY switch 58 are all open. Then the CUSTOM signal CA produced by the AND gate 66, the FINGERED CHORD signal FC produced by the AND gate 70, and the SINGLE FINGER signal SF produced by the OR gate 72 are all in a binary ZERO state.

The above noted selector 32 is under the control of the SINGLE FINGER signal SF. When this signal SF is ZERO as assumed above, the selector 32 permits the passage therethrough of the output information from the LK note detector 26. The other mentioned selector 36 is under the logical OR control of the FINGERED CHORD signal FC and SINGLE FINGER signal SF. The selector 36 permits the passage therethrough of the output information from the PK note detector 28 when both control signals FC and SF are ZERO.

The electronic musical instrument 10 is further equipped with an AUTO RHYTHM function, making it possible to automatically produce a variety of rhythm sounds. Provided for this purpose is a rhythm selector switch circuit 74 associated with a rhythm pattern memory or storage 76. The rhythm selector switch circuit 74 comprises a plurality of rhythm selector switches, not shown, the selective activation of which results in the production of an output signal indicating the desired rhythm.

The rhythm pattern memory 76 holds in storage (1) a plurality of rhythm patterns RHP corresponding to the respective rhythm selector switches in the circuit 74, (2) chord timing signals ACT, (3) bass patterns ABP, and (4) arpeggio patterns ARP, with the last three being prepared to conform to the respective rhythm patterns RHP. The rhythm patterns RHP provide timings for the production of rhythm sounds of various tone colors or timbres. The chord timing signals ACT provide timings for the production of an automatic chord accompaniment. The bass patterns ABP represent the note degree information of the bass note of an automatic bass accompaniment with respect to the root note and also provide timings for the production of such bass notes. The arpeggio patterns ARP serve to select those notes in the chord which are to be automatically sounded in arpeggio, and also provide timings for the production of such an arpeggiated chord.

Also coupled to the rhythm pattern memory 76 is a beat counter 78 fed with the tempo pulses generated by a tempo pulse generator 80. The rhythm pattern memory 76 is addressed both statically by the output from the rhythm selector switch circuit 74 and dynamically by the output from the beat counter 78. In response to the outputs from the rhythm selector switch circuit 74 and the beat counter 78, the rhythm pattern memory 76 sequentially puts out those rhythm pattern RHP, chord timing signal ACT, bass pattern ABP, and arpeggio pattern ARP which correspond to the selected rhythm.

The electronic musical instrument 10 includes means, not shown, for inhibiting the production of the chord timing signal ACT and bass pattern ABP from the rhythm pattern memory 76 when the three AUTO BASS/CHORD selector switches (i.e., the CUSTOM switch 52, FINGERED CHORD switch 54, and SINGLE FINGER switch 56) are all open. I further assume that provisions are made for preventing the production of the arpeggio pattern ARP from the rhythm pattern memory 76 when the player does not choose the AUTO ARPEGGIO function. The attached drawings do not show the means for the selection of the AUTO ARPEGGIO function since such means are not essential for an understanding of my invention.

The chord timing signal ACT and arpeggio pattern ARP are both impressed to the LK tone generator 34. The bass pattern ABP is impressed to the bass data generator 38. Derived from the bass pattern ABP, as will be detailed presently, a bass timing signal ABT is applied to the PK tone generator 40. These signals ACT, ARP, ABP and ABT when in a binary ZERO state do not affect the performances of the circuits 34, 38 and 40.

The rhythm pattern memory 76 delivers the desired rhythm pattern RHP to a rhythm tone generator 82 coupled to the amplifier 48 via a mixing resistor 84. The rhythm tone generator 82 comprises means for the production of rhythm tones of various timbres, and means for switching the produced tone signals with the applied rhythm pattern RHP, thereby producing the desired rhythm sound signal. This signal is fed through the mixing resistor 84 and amplifier 48 to the loudspeaker 50, which emanates the audible rhythm sound into the air.

For AUTO BASS/CHORD performance, based on either the CUSTOM, FINGERED CHORD, or SINGLE FINGER function, the player must activate the desired one of the CUSTOM selector switch 52, FINGERED CHORD selector switch 54, and SINGLE FINGER selector switch 56. I will discuss these three modes of AUTO BASS/CHORD performance under the respective headings.

AUTO BASS/CHORD Performance—CUSTOM Mode

Upon closure of the CUSTOM selector switch 52 the CUSTOM signal CA from the AND gate 66 becomes binary ONE. The FINGERED CHORD signal FC from the AND gate 70 and the SINGLE FINGER signal SF from the OR gate 72 both remain ZERO, however. Thus the selector 32 continues to select the output from the LK note detector 26, and the other selector 36 also continues to select the output from the PK note detector 28.

Following the activation of the CUSTOM selector switch 52 the player may proceed to depress a plurality of keys on the lower keyboard 14 to constitute a chord. He or she is also supposed to depress, on the pedal keyboard 16, a single key whose note is to become the root of the bass accompaniment to be produced automatically. As the key data channeling circuit 22 puts out the corresponding channeled key information as aforesaid, the LK note detector 26 derives therefrom the key data pertaining to the depressed keys of the lower keyboard 14 and feeds them to the LK tone generator 34 via the selector 32. In response to the input information the LK tone generator 34 generates tone signals representative of the chord constituent notes according to the depressed lower keys. The circuit 34 puts out the thus generated tone signals in synchronism with the chord timing signal ACT fed from the rhythm pattern memory 76, in such a way that the chord timing signal "triggers" or renders the tone signals at predetermined intervals. Thus the chord constituent tones are automatically sounded in a rhythmic fashion to provide a chord accompaniment.

The PK note detector 28 derives from the channeled key information a key data indicating the single depressed key of the pedal keyboard 16, delivering that data to the selector 36. Since the FINGERED CHORD signal FC and SINGLE FINGER signal SF are now both ZERO, the selector 36 permits the passage therethrough of the output from the PK note detector 28 to the bass data generator circuit 38. This circuit 38 receives not only the output from the PK note detector 28 but also the output from the LK note detector 26, via the selector 32, and the bass pattern ABP from the rhythm pattern memory 76.

Supplied with such inputs, the bass data generator circuit 38 generates, in accordance with the bass pattern ABP, the necessary coded information representative of the desired bass notes consisting of the root note selected on the pedal keyboard 16 and the notes, subordinate to the root, determined in accordance with the chord type selected by the player by the depression of the lower keys. For further details about the construction and operation of this bass data generator circuit 38, reference is directed to the U.S. Pat. No. 4,184,401, under the title of "Electronic Musical Instrument with Automatic Bass Chord Performance Device", issued to Teruo Hiyoshi, et al. and assigned to the assignee of the instant application.

The bass data generator circuit 38 delivers to the PK tone generator 40 its output data indicative of the successive bass notes of the root note and the subordinate notes to be sounded. The PK tone generator 40 generates the corresponding tone signals in response to the input data and puts out the tone signals in synchronism with the incoming bass timing signal ABT.

Although not illustrated, means are provided in this electronic musical instrument 10 for forming the bass timing signal ABT from the bass pattern ABP produced by the rhythm pattern memory 76. The bass timing signal ABT is timed with the bass pattern ABP. Thus the instrument 10 automatically produces, in timed relationship to the bass pattern ABP, the desired accompaniment of bass tones only the root of which is being selected by the player on the pedal keyboard 16 and which correspond to the type of the chord being played on the lower keyboard 14.

AUTO BASS/CHORD Performance—FINGERED CHORD Mode

The player may activate the FINGERED CHORD selector switch 54 for AUTO BASS/CHORD performance in the FINGERED CHORD mode, which provides automatic bass and chord accompaniments as he or she simply depresses some chord constituting keys on the lower keyboard 14. Upon closure of the FINGERED CHORD selector switch 54 the FINGERED CHORD signal FC from the AND gate 70 becomes binary ONE, whereas the SINGLE FINGER signal SF from the OR gate 72 remains ZERO. Consequently, although the selector 32 continues to permit the passage therethrough of the output from the LK note detector 26, the other selector 36 becomes switched to permit the passage therethrough of the output from a root note detector 86 connected between itself and the output of the LK note detector 26.

Like the selector 36 the root note detector 86 is under the logical OR control of the FINGERED CHORD signal FC and SINGLE FINGER signal SF, becoming operative when the logical OR conditions are met by the two control signals. On receipt of the output information from the LK note detector 26 the root note detector 86 detects the root note of the chord composed of the notes of the keys being depressed by the player on the lower keyboard 14. The root note detector 86 puts out the binary-coded information representative of the detected root note. The aforementioned U.S. Pat. No. 4,184,401 discloses a circuit similar in function to the root note detector 86.

The bass data generator 38 receives (1) the output from the LK note detector 26 via the selector 32, (2) the output from the root note detector 86 via the selector 36, and (3) the bass pattern ABP from the rhythm pattern memory 76. In response to these inputs the bass data generator 38 delivers to the PK tone generator 40 the output data representative of the successive bass notes of the root note and the subordinate notes to be sounded. The operation of the bass data generator 38 during AUTO BASS/CHORD performance in the FINGERED CHORD mode is analogous with that during performance in the CUSTOM mode. The only exception is that in the FINGERED CHORD mode, the circuit 38 derives the root note data from the output from the root note detector 86, instead of from the output from the PK note detector 28 as in the CUSTOM mode.

It is thus seen that the chord selected by the player on the lower keyboard 14 is sounded together with the bass tones based on the bass pattern ABP. As in the CUSTOM mode the LK tone generator 34 receives the chord timing signal ACT thereby to control the production timing of the chord with the selected rhythm and hence to sound the chord rhythmically. The bass timing signal ABT fed to the PK tone generator 40 also makes it possible to produce the bass accompaniment in the desired rhythm.

AUTO BASS/CHORD Performance—SINGLE FINGER Mode

AUTO BASS/CHORD performance in the SINGLE FINGER mode is such that the electronic musical instrument 10 provides automatic bass and chord accompaniments in response to the depression of a single lower key. The player is further required, however, to designate some desired one of a plurality (e.g., three) of kinds of chord types by depressing (or not depressing) the "white" or "black" keys of the pedal keyboard 16. The designation of any desired type of chord leads to the production of coded data for automatic production of the corresponding bass and chord accompaniments.

The player may actuate the SINGLE FINGER selector switch 56 for the SINGLE FINGER function. The SINGLE FINGER signal SF from the OR gate 72 becomes binary ONE upon closure of the SINGLE FINGER selector switch 56. Thereupon the selector 32 is switched to permit the passage therethrough of the output from a subordinate note data generator 88 connected between itself and the output of the LK note detector 26. The other selector 36 permits the passage therethrough of the output from the root note detector 86 as in the FINGERED CHORD mode.

The PK note detector 28 derives from the channeled key information from the key data channeling circuit 22 the key data concerning the pedal keyboard 16, for delivery to a chord discriminator circuit 90. This circuit 90 puts out either of three chord type designation signals, i.e., a "major" signal Mj, a "minor" signal mi, and a "seventh" signal 7th, depending upon the input information. In the illustrated embodiment the chord discriminator circuit 90 produces:

1. The "seventh" signal 7th, specifying a dominant seventh chord, when the player depresses a "white" pedal key.
2. The "minor" signal mi, specifying a minor triad chord, when the player depresses a "black" pedal key.
3. The "major" signal Mj, specifying a major chord, when the player presses neither "white" nor "black" pedal keys.

The chord discriminator circuit 90 delivers these chord type signals Mj, mi and 7th to the subordinate note data generator 88. Actuated by the SINGLE FINGER signal SF from the OR gate 72, the subordinate note data generator 88 produces the data representative of the constituent notes of the chord to be sounded, in accordance with the input information (indicating the note of single depressed lower key) from the LK note detector 26 and with either of the three chord type signals Mj, mi and 7th from the chord discriminator circuit 90. The subordinate note data generator 88 can be of known configuration comprising a subordinate note processing data generator circuit, adders, etc.

The subordinate note data generator 88 puts out, on a time-division principle, the binary-coded data representative of the constituent notes of the chord, for delivery to the LK tone generator 34 via the selector 32. The tone generator 34 also receives the chord timing signal ACT from the rhythm pattern memory 76, so that the chord is automatically sounded in the selected rhythm.

The subordinate note data generator 88 also supplies its output data to the bass data generator 38 via the selector 32. The root note detector 86 also delivers its output to the bass data generator 38 via the selector 36. The root note detector 86 is so constructed, as has been known heretofore, that during operation in the SINGLE FINGER mode, it gives priority to the lowest-note key depressed on the lower keyboard 14 in producing its output data. In the present instance, since a single lower key is being pressed, the root note detector 86 puts out the data representative of its note, which is to be used as the root note of the desired bass accompaniment.

Thus the bass data generator 38 produces the data representative of the bass notes whose root note is the note of the single depressed lower key and which correspond to the selected one of the major, minor and seventh chords. It is of course understood that the bass data generator 38 has processed the bass notes in accordance with the applied bass pattern ABP. Receiving the bass data from the bass data generator 48, the pedal keyboard tone generator circuit 40 puts out the corresponding bass tone signal in synchronism with the bass timing signal ABT.

AUTO ARPEGGIO Effect

When the player chooses the AUTO ARPEGGIO effect, the rhythm pattern memory 76 delivers the arpeggio pattern ARP to the LK tone generator 34. In response to the arpeggio pattern ARP the LK tone generator 34 selects the successive ones of chord constituent notes, whose data are being fed via the selector 32, and transforms such notes into arpeggiated tone signals in accordance with the arpeggio pattern ARP. Thus the notes played on the lower keyboard 14 are automatically sounded in arpeggio. No more detailed explanation of the AUTO ARPEGGIO function will be necessary because it does not form a feature of my invention.

Programmed Accompaniments

The following is the discussion of the way in which desired accompaniment data are introduced into the accompaniment data memory 64 for programmed accompaniments. Of the "writable" type, preferably a random access, the accompaniment data memory 64 is intended to store a plurality of measures (or bars) of accompaniment data, in an order corresponding to the sequence of such measures. In this particular embodiment the accompaniment data stored in the memory 64 are of identical character with those used during AUTO BASS-CHORD performance in the SINGLE FINGER mode. Thus the accompaniment data in the successive storage locations of the memory 64 represent the notes of individually depressed lower keys, which are to be used as the roots, and the types of the chords selected by the pedal keyboard 16.

The introduction of such desired accompaniment data into the memory 64 requires the manipulation of the WRITE switch 60 and PROGRAM switch 62, as well as of the lower and pedal keys. The WRITE switch 60 is coupled, on one hand, to a two-word-to-one-word converter 92 (hereinafter referred to simply as the word converter) via a decay differentiating circuit 94 and, on the other hand, to a first input of an AND gate 96. The second input of this AND gate 96 is coupled to the PROGRAM switch 62, and its output to the write control input WT of the accompaniment data memory 64. The PROGRAM switch 62 is further connected to a first input of an AND gate 98 via an inverter 100 and also to an attack differentiating circuit 102. The AND gate 98 has its second input coupled to the beat counter 78 and its output to a first input of an OR gate 104. This OR gate 104 has its second input connected to the decay differentiating circuit 94 and its output to a measure counter 106. The output of this measure counter is coupled both to the accompaniment data memory 64 and to a display 108.

The player may first activate the PROGRAM switch 62 for writing desired accompaniment data onto the memory 64. Upon closure of the PROGRAM switch 62 the AND gate 98 functions to inhibit the application of the "carry" signal from the beat counter 78 to the measure counter 106. Further the measure counter 106 is reset by the output from the attack differentiating circuit 102 which senses the attack of the output from the PROGRAM switch 62. The parallel bit output from the measure counter 106 now designates that address in the memory 64 where the first measure of accompaniment data are to be stored.

The player may proceed to select a desired root note on the lower keyboard 14 and a desired type of chord on the pedal keyboard 16. As those of the key switches in the circuit 18 which correspond to the depressed keys become closed, the keying sensor circuit 20 time-dividedly puts out the corresponding key data, for delivery to the word converter 92 connected between the circuit 20 and the accompaniment data memory 64. The word converter 92 acts to translate from the two-word into one-word formate the key data (pertaining to the pressed lower key and, possibly, pedal key) from the keying sensor circuit 20.

Figure 2:
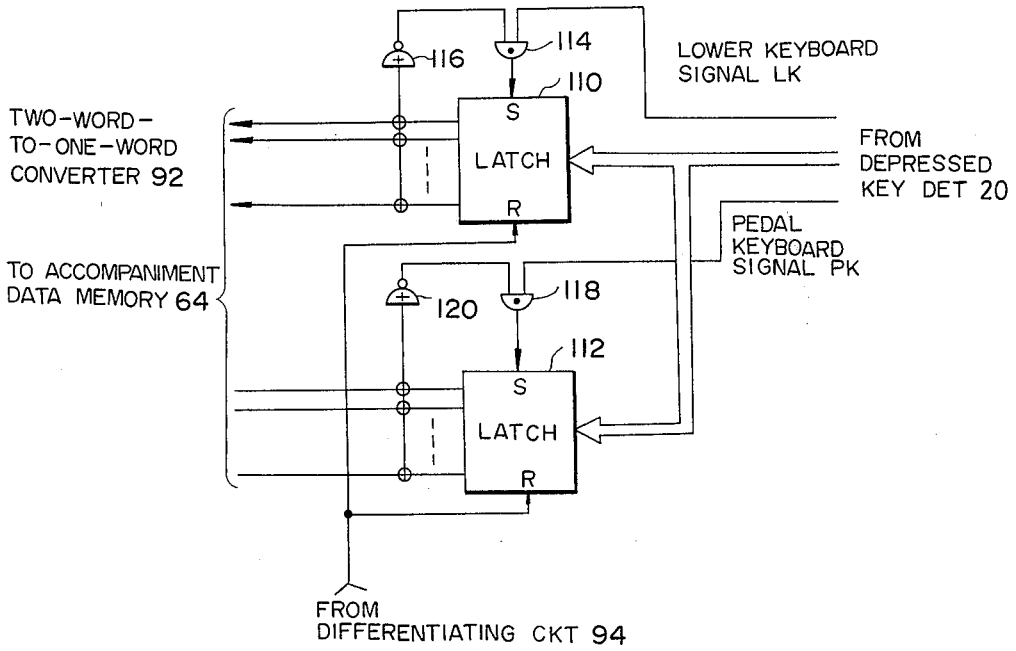
FIG. 2 is a schematic diagram, partly in block form, showing in detail a typical configuration of the two-word-to-one-word converter used in the electronic musical instrument of FIG. 1.

FIG. 2 shows a typical configuration of the work converter 92. The exemplified word converter 92 comprises two latching circuits 110 and 112 receiving the key data from the depressed key detector 20. The first latching circuit 110 has a strobe input S coupled to an AND gate 114. This AND gate 114 receives (1) the output from a NOR circuit 116 and (2) a lower keyboard signal LK indicative of those output data from the depressed key detector 20 which concern the lower keyboard 14. The NOR circuit 116 is coupled to the bit outputs of the latching circuit 110.

The second latching circuit 112 also has a strobe input S connected to an AND gate 118 receiving (1) the output from a NOR circuit 120 and (2) a pedal keyboard signal PK. The NOR circuit 120 is coupled to the bit outputs of the second latching circuit 112. The pedal keyboard signal PK is suggestive of those output data from the depressed key detector 20 which pertain to the pedal keyboard 16.

It is thus seen that the first latching circuit 110 latches the key data on the depressed keys of the lower keyboard 14, whereas the second latching circuit 112 latches the key data on the depressed keys of the pedal keyboard 16. The latching circuits 110 and 112 deliver the desired accompaniment data of one-word format to the accompaniment data memory 64. I believe it easy for the specialists to devise means for deriving the lower keyboard signal LK and pedal keyboard signal PK from the mentioned keyboard code included in the key data from the depressed key detector 20.

Now the player may activate the WRITE switch 60. The binary ONE signal generated upon closure of the WRITE switch 60 is impressed to the write control input WT of the accompaniment data memory 64 via the AND gate 96. Thereupon the accompaniment data are admitted into and stored in the memory 64 from the word converter 92.

Upon subsequent opening of the WRITE switch 60 the decay differentiating circuit 94 connected thereto delivers an output to the reset terminals R, FIG. 2, of the latching circuits 110 and 112 in the word converter 92, for clearing these circuits. The differentiating circuit 94 also supplies its output to the measure counter 106 via the OR gate 104, thereby causing the measure counter to count up and specify the next address in the memory 64 for the storage of the next measure of accompaniment data.

The repetition of the foregoing cycle of operation makes it possible to introduce a desired number of measures of accompaniment data into the memory 64. The measure counter 106 feeds its output not only to the memory 64 but also to the display 108. Thus, with the progress of the writing operation, the display 108 makes visual presentation of the number of measures that have been introduced into the memory 64.

For performance with automatic accompaniments in accordance with the data stored in the memory 64, the player may open the PROGRAM switch 62 and close the PROGRAM PLAY switch 58. Upon opening of the PROGRAM switch 62 the AND gate 98 becomes operative to permit the application of the carry signal (i.e., "measure" pulses) from the beat counter 78 to the measure counter 106. The closure of the PROGRAM PLAY switch 58 results in the application of a binary ONE signal to a gating circuit 122 thereby causing conduction therethrough, with the gating circuit 122 being connected between the memory 64 and two decoders 124 and 126 coupled to the key switch circuit 18.

The binary ONE signal from the PROGRAM PLAY switch 58 is further impressed to the OR gate 72, so that the SINGLE FINGER signal produced by this OR gate becomes binary ONE. The inverter 68 inverts the binary ONE signal from the PLAY switch 58 as it is applied to the AND gates 66 and 70, with the result that the CUSTOM signal CA and FINGERED CHORD signal FC remain binary ZERO. It is thus seen that the activation of the PROGRAM PLAY switch 58 leads to the automatic conditioning of the electronic musical instrument 10 for the SINGLE FINGER mode.

AS the PROGRAM switch 62 is now open as aforesaid, the beat counter 78 drives the measure counter 106 by its output "measure" pulses. In step with such driving of the measure counter 106 the accompaniment data memory 64 puts out the desired accompaniment data (concerning the lower keyboard 14 and pedal keyboard 16). The accompaniment data are applied via the gating circuit 122 to the two decoders 124 and 126, which function to decode the input data into key signals corresponding to the individual keys of the lower keyboard 14 and to the individual keys of the pedal keyboard 16, respectively, for application to the key switch circuit 18.

The key switch circuit 18 includes field-effect transistor gates connected in parallel with the respective key switches corresponding to the keys of the lower keyboard 14 and with the respective key switches corresponding to the keys of the pedal keyboard 16, as will be detailed subsequently. The key signals from the decoders 124 and 126 can cause conduction through the corresponding field-effect transistor gates. Conduction of any field-effect transistor gate, therefore, is functionally equivalent to the closure of the key switch connected in parallel therewith and, consequently, to the pressing of the corresponding lower or pedal key.

Figure 3:
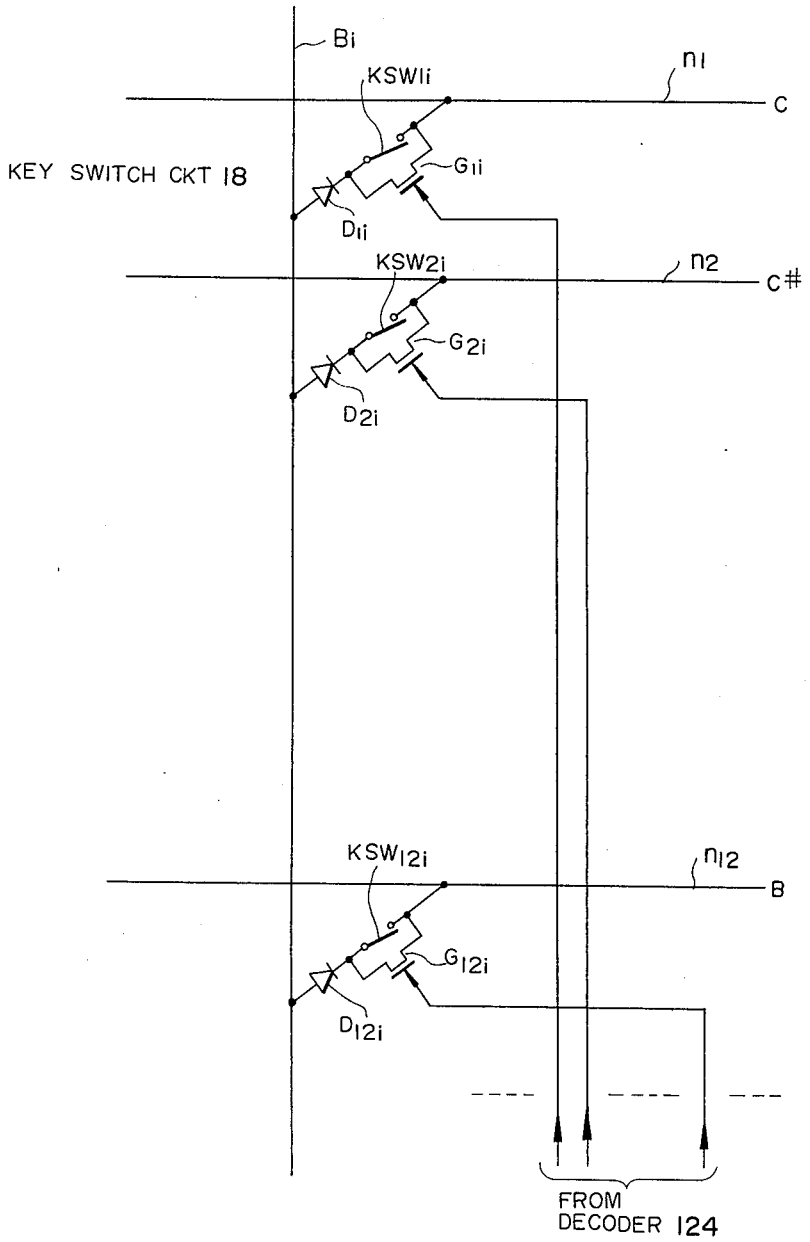
FIG. 3 is a fragmentary schematic diagram showing in detail a typical configuration of the key switch circuit in the electronic musical instrument of FIG. 1.

FIG. 3 is a fragmentary schematic of the key switch circuit 18, showing only the key switches $KSW_{1i}$, $KSW_{2i}$, . . . $KSW_{12i}$, as well as associated means, corresponding to the twelve "white" and "black" keys C, C#, . . . B of the lower keyboard 14 forming an arbitrary octave i. The twelve key switches of the octave i are connected, via respective diodes $D_{1i}$, $D_{2i}$, . . . $D_{12i}$, at the intersections of lines $n_1$, $n_2$, . . . $n_{12}$ corresponding to the twelve notes C through B and a line $B_i$ corresponding to the octave i, with the note and octave lines forming a matrix. The key switches $KSW_{1i}$ through $KSW_{12i}$ are connected in parallel with the noted field-effect transistor gates $G_{1i}$, $G_{2i}$, . . . $G_{12i}$ respectively.

Applied separately to the field-effect transistor gates $G_{1i}$ through $G_{12i}$ are the key signals from the decoder 124 for causing selective conduction therethrough. The keying sensor circuit 20 senses any closed key switch by the time-division scanning of the lines $n_1$ through $n_{12}$ and the line $B_i$. As has been pointed out, the conduction of any field -effect transistor gate, due to the key signal from the decoder 124, is equivalent to the closure of the key switch connected in parallel therewith. Consequently the depressed key detector 20 puts out information representative of the single selected lower key corresponding to the conductive gate. The foregoing description of FIG. 3 applies to the key switches and associated means corresponding to the lower keys of other than the octave i and to all pedal keys.

The depressed key detector 20 thus puts out the key data on the selected lower key and pedal key. On receipt of the key data the key data channeling circuit 22 assigns the notes of the selected keys to suitable sounding channels. The LK note detector 26 and PK note detector 28 subsequently derive from the channeled key data the key data representing the lower and pedal keys, respectively. The electronic musical instrument 10 processes the outputs from the circuits 26 and 28 just as it does during AUTO BASS/CHORD performance in the SINGLE FINGER mode, providing automatic bass and chord accompaniments based on the roots represented by the output data of the LK note detector 26 and on the types of chords represented by the output data (i.e. no key, white key or black key) of the PK note detector 28.

It will now be clear that the programmed accompaniments in accordance with my invention proceed in conformity with the accompaniment data being read from the memory 64 in steps (sequentially) with the output from the measure counter 106. If the player depresses some desired lower and pedal keys during the progress of such programmed accompaniments, the corresponding key switches in the circuit 18 will close individually, as is apparent from FIG. 3. The player may therefore temporarily deviate from the programmed accompaniments and play some AUTO BASS/CHORD accompaniments in the SINGLE FINGER mode by selecting desired roots and desired types of chords on the lower and pedal keyboards 14 and 16.

For such temporary deviation from the programmed accompaniments a desired measure or measures may be made blank in introducing the successive measures of accompaniment data into the memory 64. The player is then free to play desired AUTO BASS/CHORD accompaniments during such a blank measure of measures. The display 108 visually represents the number of measures being played, by receiving the output from the measure counter 106. The player may therefore recognize the blank measure or measures from the display 108 and play AUTO BASS/CHORD accompaniments of his or her choice during the blank measure or measures.

Second Form

Figure 4:
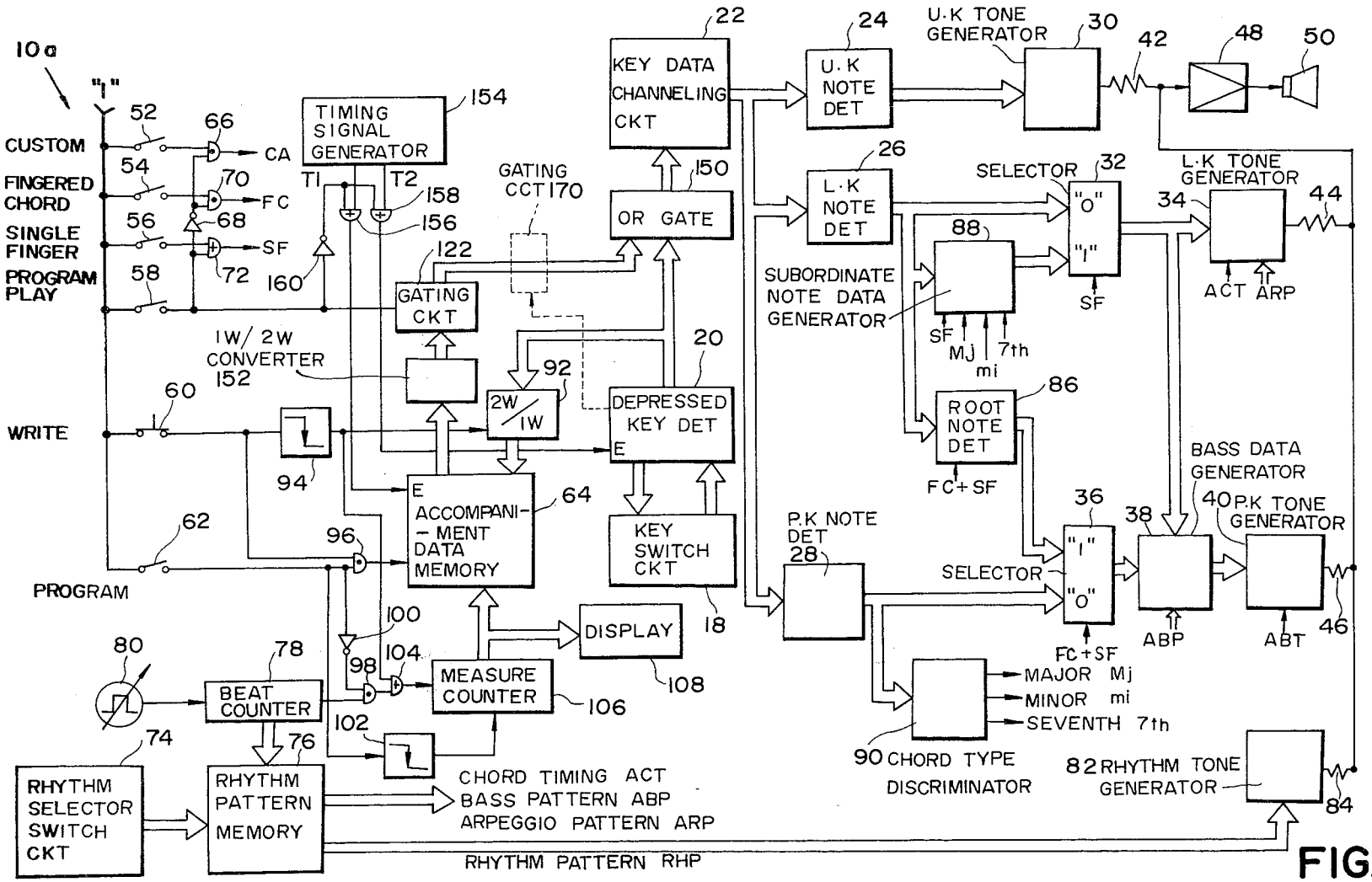
FIG. 4 is a block diagram of another preferred form of the electronic musical instrument in accordance with my invention, the diagram also showing a phantom gating circuit by way of an additional embodiment of my invention.

FIG. 4 shows another preferable form of the electronic musical instrument in accordance with my invention. Since most parts or components of this modified instrument, generally designated 10*a*, can be identical in construction and function with the corresponding parts of the preceding embodiment, I will identify such corresponding parts by like reference numerals.

The electronic musical instrument 10*a* differs from the instrument 10 of FIG. 1 in that, first of all, the outputs of the depressed key detector 20 and the accompaniment data memory 64 are both coupled to the key data channeling circuit 22 via an OR gate 150. The depressed key detector 20 delivers the key data to the channeling circuit 22 directly through the OR gate 150. The accompaniment data memory 64, on the other hand, supplies the accompaniment data to the key data channeling circuit 22 via a one-word-to-two-word converter circuit 152 (hereinafter referred to as the 1W/2W converter, in contradistinction to the 2W/1W converter 92), the gating circuit 122 and the OR gate 150.

Figure 5:
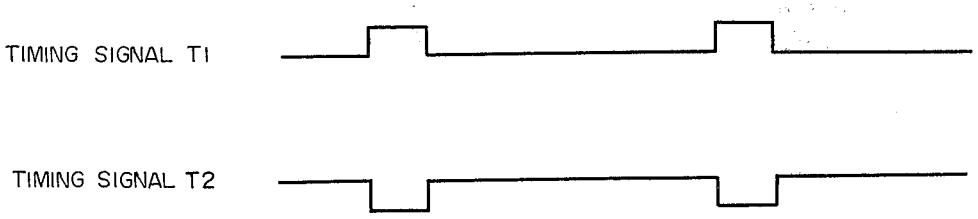
FIG. 5 is a chart of waveforms useful in explaining the operation of the electronic musical instrument of FIG. 4.

In view of the fact that the depressed key detector 20 and accompaniment data memory 64 may produce their outputs simultaneously during the closure of the PROGRAM PLAY switch 58, a timing signal generator circuit 154 is provided for causing the circuit 20 and memory 64 to put out the desired data at different moments in time. The timing signal generator circuit 154 generates two timing signals T1 and T2, FIG. 5, of inverse relationship to each other. The circuit 154 delivers these timing signals T1 and T2 to the "enable" terminals E of the accompaniment data memory 64 and the depressed key detector 20 via OR gates 156 and 158 respectively.

Each binary ONE state of the timing signal T1 lasts for a length of time (e.g., 96 microseconds) sufficient for the accompaniment data memory 64 to put out one word. The other timing signal T2, on the other hand, remains in each binary ONE state for a length of time sufficient for the depressed key detector 20 to complete one scanning cycle of the key switch circuit 18. Thus, in response to the two timing signals T1 and T2, the depressed key detector 20 and accompaniment data memory 64 alternately operate in a time-division multiplexed manner. There is accordingly no likelihood of the depressed key detector 20 and accompaniment data memory 64 concurrently delivering their outputs to the key data channeling circuit 22.

The other input of each of the OR gates 156 and 158 is coupled to the PROGRAM PLAY switch 58 via an inverter 160. As long as the PROGRAM PLAY switch 58 is open, therefore, the depressed key detector 20 and accompaniment data memory 64 are capable of continuous operation, being unaffected by the timing signals T1 and T2.

It will be recalled that the accompaniment data stored in the memory 64 are of one-word format. As they are sequentially recovered from the memory 64, therefore, the accompaniment data must be translated into two word key data representing the depressed lower and pedal keys, prior to delivery to the key data channeling circuit 22. The 1W/2W converter 152 serves this purpose. The other details of configuration of this modified instrument 10*a* can be as set forth above in connection with the instrument 10 of FIG. 1.

For performance with programmed accompaniments on the modified electronic musical instrument 10*a*, the player may open the PROGRAM switch 62 and close the PROGRAM PLAY switch 58. Thereupon the memory 64 puts out the one-word accompaniment data, as dictated by the output from the measure counter 106. The 1W/2W converter 152 transforms the one-word accompaniment data into the corresponding two-word key information as aforesaid and feeds the key information to the channeling circuit 22 via the gating circuit 122 and OR gate 150. The musical instrument 10*a* is thus enabled to make automatic, programmed accompaniments based on the SINGLE FINGER mode, with the roots of such accompaniments being selected by the lower keyboard 14 and with the three available types of chords being selected by the pedal keyboard 16. I have already explained, in connection with FIG. 1, the programmed accompaniment function in the SINGLE FINGER mode, so that no more description will be necessary on this subject.

The modified electronic musical instrument 10*a* also permits the player to play some desired AUTO BASS/CHORD accompaniments during the progress of the programmed accompaniments. Upon depression of desired lower and pedal keys in the course of the programmed accompaniments, the corresponding key switches in the circuit 18 will close, with the result that the depressed key detector 20 puts out the key data denoting the depressed keys. The key data are directed via the OR gate 150 to the key data channeling circuit 22, which assigns the incoming key data to some appropriate sounding channels. Thus the player can select, on the lower and pedal keyboards, the desired root notes and desired kinds of chords necessary for the production of AUTO BASS/CHORD accompaniments in the SINGLE FINGER mode during performance with the programmed accompaniments.

The programmed accompaniments and the uprogrammed AUTO BASS/CHORD accompaniments should not take place at the same time, however. As in the preceding embodiment, therefore, the programmed accompaniment data in the memory 64 should include a blank measure or measures, during which the player can play some desired AUTO BASS/CHORD accompaniments.

Modifications

While I have herein shown and described my invention in what I have conceived to be the most practical and preferred embodiments, it is recognized that modifications thereof may be made within the scope of my invention. Typical of such possible modifications is the phantom gating circuit 170, FIG. 4, connected between gating circuit 122 and OR gate 150. The gating circuit 170 becomes nonconductive in response to a control signal delivered from the depressed key detector 20 when any of the lower and pedal keys is pressed. The memory 64 is therefore unable to supply the programmed accompaniment data to the OR gate 150 when the player presses any lower and pedal keys to play some desired AUTO BASS/CHORD accompaniments during the progress of programmed accompaniments. The gating circuit 170 enables the player to override the programmed accompaniments. He may play desired AUTO BASS/CHORD accompaniments at any time, even if the programmed accompaniment data in the memory 64 contain no blanks.

I realize that certain additional modifications may well occur to one skilled in the art within the broad teaching hereof. It is my intention, therefore, that the scope of protection afforded hereby shall be limited only insofar as such limitations are expressly set forth in the appended claims.

I claim:

1. In an electronic musical instrument capable of providing an automatic accompaniment, in combination:

(a) keyboard means to be played on by the player;
(b) an accompaniment data memory;
(c) means for introducing a desired sequence of accompaniment data into the accompaniment data memory for storage therein using certain keys of said keyboard means for selection of said desired data;
(d) means for causing the accompaniment data memory to put out the accompaniment data in the desired sequence; and
(e) means for producing an accompaniment both in accordance with the accompaniment data recovered from the accompaniment data memory and in response to the depressing of ones of said certain keys on the keyboard means while said means for causing is operative.

2. The electronic musical instrument as recited in claim 1, further comprising means for visually presenting the number of measures being introduced into, and recovered from, the accompaniment data memory.

3. In an electronic musical instrument capable of providing an automatic accompaniment, in combination:

(a) keyboard means to be played on by the player;
(b) an accompaniment data memory;
(c) means for introducing a desired sequence of accompaniment data into the accompaniment data memory for storage therein;
(d) means for causing the accompaniment data memory to put out the accompaniment data in the desired sequence;
(e) means for producing an accompaniment both in accordance with the accompaniment data recovered from the accompaniment data memory and in response to the depressing of keys on the keyboard means; and
(f) means for inhibiting the delivery of the accompaniment data from the accompaniment data memory to the producing means while the latter is producing an accompaniment in response to the depressing of keys on the keyboard means.

4. In an electronic musical instrument capable of providing an automatic accompaniment, the instrument being of the type having keyboard means, means for generating key data representative of any pressed key of the keyboard means, and means for processing the key data in order to produce audible sound, the combination thereof with:

(a) an accompaniment data memory;
(b) means for writing a desired sequence of accompaniment data on the accompaniment data memory through the key data generating means by depressing desired keys in a certain portion of the keyboard means;
(c) means for reading the accompaniment data from the accompaniment data memory in the desired sequence; and
(d) means coacting with the processing means for producing an automatic accompaniment both in response to the accompaniment data being read from the accompaniment data memory and to a pressed key or keys in said certain portion of the keyboard means;
(e) whereby the player is enabled to play a desired automatic accompaniment by pressing a key or keys in said certain portion of the keyboard means during the progress of the automatic accompaniment in accordance with the accompaniment data being read from the accompaniment data memory.

5. The electronic musical instrument as recited in claim 4, wherein the keyboard means includes a key switch circuit responsive to the pressing of the individual keys for enabling the generating means to generate the key data, and wherein the key switch circuit is adapted to receive the accompaniment data being read from the accompaniment data memory, the generating means being effective to generate the key data representative of the accompaniment data in the key switch circuit.

6. In an electronic musical instrument capable of providing an automatic accompaniment, the instrument being of the type having keyboard means, means for generating key data representative of any pressed key of the keyboard means, and means for processing the key data in order to produce audible sound, the combination thereof with:

(a) an accompaniment data memory;
(b) means for writing a desired sequence of accompaniment data on the accompaniment data memory through the key data generating means by depressing desired keys of the keyboard means;

(c) means for reading the accompaniment data from the accompaniment data memory in the desired sequence;

(d) means coacting with the processing means for producing an automatic accompaniment in response to the accompaniment data being read from the accompaniment data memory and to a pressed key or keys of the keyboard means;

(e) whereby the player is enabled to play a desired automatic accompaniment by pressing a key or keys of the keyboard means during the progress of the automatic accompaniment in accordance with the accompaniment data being read from the accompaniment data memory; and (f) wherein the accompaniment data being read from the accompaniment data memory are delivered to the processing means in time-division multiplexed relationship with the key data fed from the generating means.

7. An electronic musical instrument with an automatic bass and chord accompaniment function, comprising:

(a) a plurality of keyboards;

(b) means for generating key data representative of any depressed key of the keyboards;

(c) means for processing the key data in order to produce desired tones;

(d) automatic accompaniment means for producing, in coaction with the processing means, automatic bass and chord accompaniments in response to a pressed key or keys of a predetermined one or ones of the keyboards;

(e) programmed accompaniment means comprising:

(1) an accompaniment data memory;

(2) means for introducing a sequence of desired bass and chord accompaniment data into the accompaniment data memory through the key data generating means by pressing desired keys of the predetermined one or ones of the keyboards; and (3) means for sequentially recovering the bass and chord accompaniment data from the accompaniment data memory; and (f) the key data processing means and the automatic accompaniment means being effective to produce the programmed bass and chord accompaniments concurrently both in response to the bass and chord accompaniment data being recovered from the accompaniment data memory and in response to the depressing of ones of the keys of said predetermined one or ones of the keyboards.

8. The electronic musical instrument as recited in claim 7, wherein the accompaniment data memory stores successive measures of bass and chord accompaniment data in the form of root note and chord type information, and wherein said key data processing means and said automatic accompaniment means produce bass and chord accompaniments automatically in response to said root note and chord type information.

9. The electronic musical instrument as recited in claim 8, wherein the keyboards include an upper keyboard and a lower keyboard and a pedal keyboard, and wherein the bass and chord accompaniment data include information on root notes selected on the lower keyboard and information on a plurality of available types of chords selected on the pedal keyboard.

* * * * *